US009782737B2

(12) United States Patent
Bublewitz et al.

(10) Patent No.: US 9,782,737 B2
(45) **Date of Patent: *Oct. 10, 2017**

(54) CARTRIDGE SYSTEM AND STATIC MIXER THEREFOR

(71) Applicant: Kettenbach GmbH & Co. KG, Eschenburg (DE)

(72) Inventors: Alexander Bublewitz, Herborn (DE); Jens-Peter Reber, Meinerzhagen (DE)

(73) Assignee: Kettenbach GmbH & Co. KG, Eschenburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/440,664

(22) Filed: Feb. 23, 2017

(65) Prior Publication Data

US 2017/0157581 A1 Jun. 8, 2017

Related U.S. Application Data

(63) Continuation of application No. 14/240,298, filed as application No. PCT/EP2012/065689 on Aug. 10, 2012, now Pat. No. 9,700,859.

(30) Foreign Application Priority Data

Aug. 24, 2011 (DE) ..... 10 2011 111 046
Oct. 26, 2011 (EP) ..... PCT/EP2011/068784
Feb. 23, 2012 (DE) ..... 10 2012 003 390

(51) Int. Cl.
*B01F 15/00* (2006.01)
*B01F 13/00* (2006.01)
(Continued)

(52) U.S. Cl.
CPC ..... *B01F 15/0087* (2013.01); *B01F 5/0614* (2013.01); *B01F 13/0023* (2013.01);
(Continued)

(58) Field of Classification Search
CPC ..... B01F 15/0202; B01F 15/0087; B01F 13/0023; B01F 15/0216; B05C 17/00513
See application file for complete search history.

(56) References Cited

U.S. PATENT DOCUMENTS 4,981,241 A 1/1991 Keller
5,487,606 A 1/1996 Keller
(Continued)

FOREIGN PATENT DOCUMENTS

DE 202006004738 U1 6/2006
DE 202011002407 U1 4/2011
(Continued)

*Primary Examiner* — Tony G Soohoo
*Assistant Examiner* — Anshu Bhatia
(74) *Attorney, Agent, or Firm* — McDonnell Boehnen Hulbert & Berghoff LLP

(57) ABSTRACT

The invention relates to a cartridge system with two containers (2*a*, 2*b*) respectively having an outlet connector (4*a*, 4*b*), and a common connection section for a mixer (1) having a positioning aperture (7), and with a static mixer (1) with inlet connectors (14*a*, 14*b*) and a positioning element (16). The connection section of the cartridge comprises a ring (5) having an inner thread (6) that surrounds the outlet connectors (4*a*, 4*b*), whereby the mixer (1) has an outer thread (11). Further, the invention relates to a static mixer (1) for a cartridge system of this type.

4 Claims, 6 Drawing Sheets

(51) Int. Cl.
*B01F 15/02* (2006.01)
*B01F 5/06* (2006.01)
*B05C 17/005* (2006.01)

(52) U.S. Cl.
CPC .... *B01F 15/0216* (2013.01); *B05C 17/00513* (2013.01); *B05C 17/00553* (2013.01); *B05C 17/00579* (2013.01)

(56) References Cited

U.S. PATENT DOCUMENTS

| | | | |
|---|---|---|---|
| 5,498,078 | A | 3/1996 | Keller |
| 6,398,761 | B1 | 6/2002 | Bills et al. |
| 7,316,330 | B2 | 1/2008 | Muller et al. |
| 8,100,295 | B2 | 1/2012 | Keller |
| 2007/0095865 | A1 | 5/2007 | Chick |
| 2010/0102088 | A1 | 4/2010 | Keller |
| 2010/0208544 | A1 | 8/2010 | Wintersgate et al. |
| 2011/0198370 | A1* | 8/2011 | Ho ..... B01F 5/0615 222/137 |
| 2012/0199607 | A1 | 8/2012 | Keller |
| 2013/0205988 | A1 | 8/2013 | Bublewitz et al. |
| 2014/0124536 | A1* | 5/2014 | Pappalardo ..... B05C 17/00506 222/137 |

FOREIGN PATENT DOCUMENTS

| | | | |
|---|---|---|---|
| EP | 0584428 | B1 | 3/1994 |
| EP | 0664153 | B1 | 7/1995 |
| EP | 0723807 | B1 | 7/1996 |
| EP | 1440737 | A1 | 7/2004 |
| EP | 1972387 | A2 | 9/2008 |
| WO | 2004009249 | A1 | 1/2004 |
| WO | 2007109915 | A1 | 10/2007 |
| WO | 2009033832 | A1 | 3/2009 |
| WO | 2010041075 | A2 | 4/2010 |
| WO | 2011041917 | A1 | 4/2011 |

* cited by examiner

CARTRIDGE SYSTEM AND STATIC MIXER THEREFOR

CROSS REFERENCE TO RELATED APPLICATIONS

The present application is a continuation of U.S. patent application Ser. No. 14/240,298 filed Feb. 21, 2014 which is a U.S. National Phase Application pursuant to 35 U.S.C. §371 of International Application No. PCT/EP2012/065689 filed Aug. 10, 2012, which claims the benefit of German Patent Application No. 102011111046.5 filed Aug. 24, 2011 which claims priority to International Application No. PCT/EP2011/068784, filed Oct. 26, 2011 which claims priority to German Patent Application No. 102012003390.7 filed Feb. 23, 2012. The entire disclosure contents of these applications are herewith incorporated by reference into the present application.

The invention relates to a cartridge system with two containers respectively provided with an outlet connector and a common connecting section provided with a positioning aperture for a mixer, and with a static mixer with inlet connectors and a positioning element. Further, the invention relates to a static mixer that is especially suited for use with such a cartridge system.

Cartridge systems of the type cited at the beginning are known from WO 2011/041917 and EP 0 723 807 B1. These types of known cartridge systems most often have a bayonet joint for connecting the static mixer and the containers of the cartridge. Often, it is an important aspect of the connection between the mixer and the cartridge that the mixer should be placed on the cartridge in a certain position so that the inlet and outlet connectors meet, whereby it is to be avoided that the mixer is out of alignment. For this reason, so-called coding elements must be provided that prevent a firm connection between the mixer and the cartridge if the mixer is out of alignment when it is placed on the cartridge. Thereby, the known cartridge systems cannot reliably ensure that any misaligned contact between the inlet and outlet connectors relative to the cartridge is avoided.

This can lead to a so-called cross contamination, i.e. the component in one of the outlet connectors comes in contact with the component in the other outlet connector in the area of the inlet or outlet connectors already, and can react there, and perhaps harden, which is unwanted.

Further, from DE 20 2011 002 407 U1, a mixer having a guide rib is known which can be mounted on a cartridge by means of a retaining clip.

Mixers and cartridge systems of this type also sometimes have the problem that one of the components to be discharged from the cartridge tends to flow at a faster rate, i.e. discharges faster from the respective container than the component within the other container. Concerning this, it is known from EP 0 584 428 B1 or EP 0 664 153 B1, to design the inlet area of a mixer in such a way that the component tending to run ahead is caught in the inlet area of the mixer or is redirected before the components are mixed in the mixing area of the mixer. But these steps are connected with an increase in the flow resistance within the mixer due to multiple redirections of the component, which is found to be a disadvantage, depending on the viscosity.

From EP 1 972 387 A2, a mixer is known, which can be mounted to a cartridge by means of an adapter. The adapter has a pin-like protrusion that can engage with a corresponding aperture on the cartridge housing to establish alignment relative to the cartridge.

In contrast, it is the objective of the present invention to provide a cartridge system and a static mixer for such in which no cross contamination can occur. A further aspect of the present invention lies in the improvement of the flow characteristics within the mixer, and a simple and reliable connection between the mixer and the cartridge.

According to the invention, this problem is solved with a cartridge system with the characteristics of claim 1. The connection between the two containers (cartridge) and the mixer is thereby preferably accomplished by a threaded connection, whereby the connection section of the containers has a ring with an inner thread surrounding the outlet connectors, while the mixer has an outer thread which is provided, for example, on the outer side of the mixer housing. According to the invention, the length of the inlet connectors, the outlet connectors and the positioning element as well as the position of the positioning aperture are coordinated with each other in such a way that when placing the mixer onto the containers, the positioning element engages with the positioning aperture, before the inner thread and the outer thread engage. Additionally, according to the invention, the inner thread and the outer thread engage before the inlet connectors and the outlet connectors make contact.

For this, the positioning element, which can be designed as a bar or a latch, for example, projects in the direction toward the cartridge beyond the inlet connectors of the mixer according to a preferred embodiment. Thus, the positioning element first engages with the slot or similar aperture at the cartridge while the mixer is being mounted to the cartridge, before the threads of the inner thread collar of the cartridge and the outer thread of the mixer can engage. In addition, as the inlet connectors of the mixer and the outlet connectors of the cartridge can come in contact only then, when the thread of the cartridge and the mixer engage, it is ensured that by engaging the positioning element with the corresponding positioning aperture, the alignment of the mixer relative to the cartridge is determined first, before the remaining components can make contact.

Thereby, the positioning element can facilitate bringing the mixer close to the cartridge, as well as ensure a positive alignment and association of the mixer with the cartridge. This has the advantage that the mixer and cartridge can be brought together easily and intuitively with more degrees of freedom compared to known bayonet connections. In other words, the positioning element according to the invention differentiates itself from a coding element that is known, for example, from EP 0 723 807 B1, among other things therein, that the mixer is guided in the cartridge and brought into the desired alignment even before the actual connection of the mixer and the cartridge begins. Furthermore, from the start of the connection process, the positioning element ensures the correct alignment of the inlets and outlets with respect to each other, in the absence of these being able to make contact in a different alignment. The threaded connection also ensures an especially firm and secure interlock of the mixer in the cartridge, whereby this interlock can be released easily.

Preferably, the positioning latch is guided funnel-shaped in the aperture in sliding manner when the outlet connectors and the inlet connectors are slid into each other forming a seal. In other words, the positioning latch is in contact with the aperture during the assembly of the mixer on the containers of the cartridge and aligns the inlet and outlet connectors as well the threads with each other. In practice, this is especially relevant for a cartridge inserted in a discharge device when a mixer is frequently exchanged, as the inlet and the outlet connectors are hereby usually hidden from the user, so that it is important that the connectors and the threads align automatically.

Prior to the first start-up of such a cartridge system, a small amount of the components contained in the containers is often discharged without placing the mixer onto the cartridge. The discharge of components takes place via plungers within the containers so that by discharging a small amount of the components prior to the first mixing process, possible tolerances within the container or the position of the plungers, or the fill levels of the containers can be compensated, in order to, as much as possible, feed both components evenly at the beginning of the actual mixing process. Because of the ring with the thread surrounding the outlet connector of the cartridge, there is a risk that the inner thread of the ring will be contaminated by components discharging from the containers, which can also make mounting the mixer more difficult. According to a preferred embodiment of the invention, the outlet connectors therefore project over the ring surrounding the outlet connectors in the direction of the mixer. Because of the protrusion of the outlet connectors with respect to the ring, a contamination of the interior area of the ring is avoided as much as possible, and the components escaping from the cartridge can be captured and discarded.

The cartridge system according to the invention is suitable for components that are to be mixed at a mixing ratio of 1:1, and also for mixing ratios other than 1:1. To control the flow-through amounts at various dosing ratios, the inner diameters of the outlet channels of the cartridge are preferably selected to be of the same size for both components, whereby on account of, for example, cylindrical cores in the interior of the outlet channels, a volume of the outlet channels can be selected that corresponds to the desired dosing ratios. Thus it is possible, for example, to locate cylinder cores of this type attached using bars at the center within the outlet connectors. Hereby, it can be sufficient to provide such a cylinder core in only one of the two outlet connectors. Alternatively, or in addition to the cylinder cores, in at least one of the two inlet connectors of the mixer, a cross section tapering can be provided. This (inner) cross section tapering can be designed as an insert or as a conically extending channel, for example, so that for mixing ratios that are different than 1:1, the correct amount of the components arrives in the mixer.

The problem on which the invention is based is also solved by a static mixer with the characteristics of claim 4. For this, a static mixer according to the invention has a mixing area that extends parallel to a longitudinal axis of the mixer and in which a mixing element is provided, and a coupling section that is suitable for connecting the mixer with the cartridge. Thereby, the coupling section can have two inlets respectively in flow connection with the mixing area via channels, and a positioning element. According to the invention, the coupling section also has an outer thread so that the coupling section can be formed by different components of the mixer, in particular, by the housing and an insert. Further, preferably, the two inlets are designed as connectors at a distance from each other, having a separating wall between them. To avoid cross contamination, the positioning element preferably projects over the two inlets of the mixer in the direction of the longitudinal axis. In particular, the positioning element also projects over a separating wall that is perhaps provided and over the housing of the mixer so that the positioning element must first be inserted into the corresponding aperture of the cartridge before other components of the mixer come in contact with the cartridge.

According to a preferred embodiment, for mixing ratios other than 1:1, a first inlet has a reservoir chamber associated with it that is located between the first inlet and the mixing area, and has a cross section surface that is larger than the cross section surface of the channel section between the first inlet and the reservoir chamber. In other words, the cross section surface of the inlet channel of the mixer is smaller than the cross section surface of the reservoir chamber so that in the reservoir chamber, a component that tends to run forward can be caught, as a result of which this component reaches the actual mixing area with a delay or only a subsequent flow of this component reaches the actual mixing area.

The flow characteristics within the static mixer have shown to be particularly favorable when the cross section surface of the channel section located between the first inlet and the reservoir chamber is approximately 80% and approximately 150% of the cross section surface of an aperture, or a channel section that ends in the mixing area. As a result of this avoidance of cross section tapering downstream of the reservoir chamber, even more viscous components with comparably lower delivery forces can be delivered.

Furthermore, it is preferred when the channel section located between the first inlet and the reservoir chamber is opposite to an aperture or an (additional) channel section in axial direction that ends, for example, in the mixing area. Even an absence of redirections or their minimization in the channel located between the inlet and the mixing area minimizes the flow resistance. Alternatively, the channel section located between the first inlet and the reservoir chamber in axial direction can be located offset to an aperture or an (additional) channel section that ends, for example, in the mixing area.

If the effect of one component running forward as a result of the mixer design according to the invention is compensated or is to be minimized, it is preferred when the channel that connects the second inlet with the mixing area reaches into the mixing area as directly as possible, whereby this channel can run past the reservoir chamber or through it. For mixing ratios other than 1:1 it is additionally preferred when the cross section surface of this second channel is smaller than the channel section between the first inlet and the reservoir chamber.

To reduce the risk of a cross contamination even further, it is preferred when the separating wall provided between the connectors of the inlets projects over these connectors in the direction toward the cartridge. Even if in a delivery of components prior to the start of the first mixing process, residuals of the components are present at the outlet connectors of the cartridges, these are not able to soil or contaminate the inlet connectors of the mixer, because of the separating wall. The same applies when one mixer that has already been used is removed and a new mixer is placed onto the cartridge. Regardless of the positioning element, even the separating wall is a contributing factor so that the mixer cannot be placed onto the cartridge in any position.

According to a particularly preferred embodiment of the invention, the mixer consists of precisely two components, namely, a housing and an insert that is axially secured and housed in the housing rotatable with respect to it. The housing thereby forms, in particular, a cylindrical mixing area and has an expanding area relative to the mixing area that forms the coupling section. This flared section of the housing can be provided with an outer thread with which the mixer can be firmly connected with the cartridge. As a result of the rotatability of the insert relative to the housing, an interlock of the mixer at the cartridge can be established by screwing, even if prior to that, the insert of the mixer is aligned relative to the cartridge by means of the positioning element. This also makes it possible that while the mixer is being screwed onto the cartridge, the inlet connectors of the mixer and the outlet connectors of the cartridge engage. To do so, preferably, the inlet connectors of the mixer are inserted into the outlet connectors of the cartridge.

The sealing between the two components of the mixer can be established axially and/or radially. An axial sealing with two consecutively abutting sealing sections of the housing or the insert in the longitudinal direction of the mixer has the advantage that the sealing effect is improved when the threaded connection with the cartridge is tightened. The insert of the mixer can thus first be freely rotatable in the housing and the sealing function takes effect (completely) only after the mixer is mounted onto the cartridge. The radial seal has the advantage that for it, for example, a radial groove and a surrounding radial bar can be used that can be provided for a freely rotatable connection of the two components of the mixer.

In cartridge systems, it is customary to leave the mixer mounted to the cartridge after the mixing process, whereby the components that are still contained in the mixer can react with each other in the mixer and harden. In this way, the mixer forms a lock for the cartridge which can be removed prior to another use of the cartridge with a new mixer. As a result of the threaded connection according to the invention, between the mixer and the cartridge, the housing of the mixer must be screwed out of the threaded ring of the cartridge. But at the same time, the insert of the mixer continues to be connected twist-safe with the cartridge via the positioning element and the inlet connectors. Screwing off the mixer therefore requires, a relative rotational motion between the insert of the mixer and the housing of the mixer, whereby such a relative motion is made more difficult when the components have hardened, when the mixer element, for example, a mixing helix is designed integral with the insert.

It is therefore preferred when the insert of the mixer has the mixing element, the two inlets and the positioning element as an integrated component, whereby the mixer element can be separated from the two inlets and the positioning element via a predetermined braking point.

In the following, the invention is described in further detail with the help of an exemplary embodiment and by referring to the drawings.

The following are shown schematically:

Figure 1:
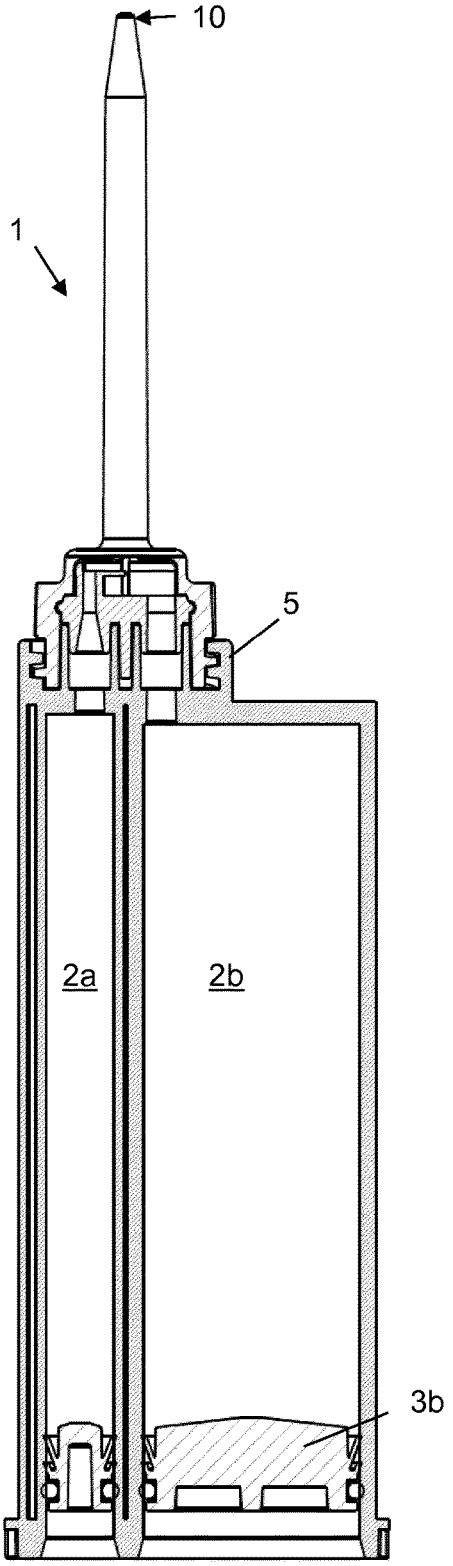
FIG. 1 shows a longitudinal cross section through a cartridge system according to a first embodiment of the invention.
Figure 2:
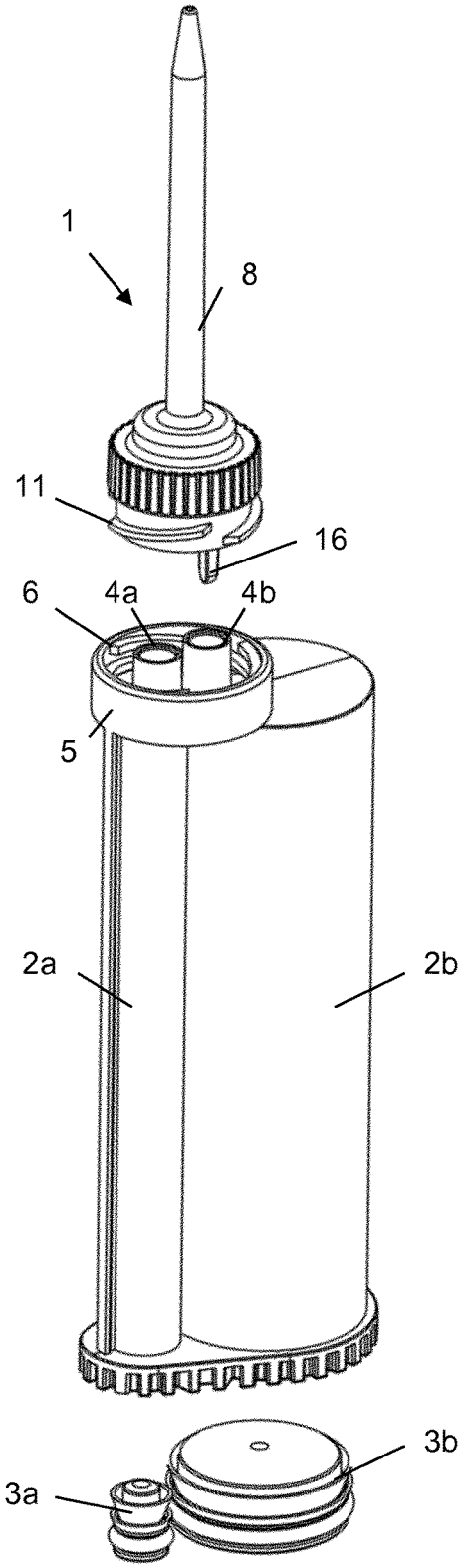
FIG. 2 shows a perspective view of the cartridge system according to FIG. 1.
Figure 3:
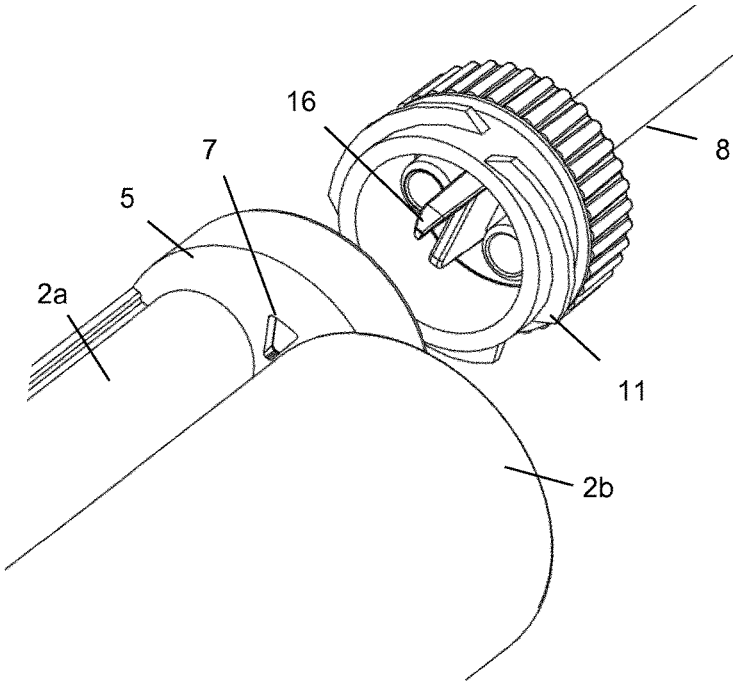
FIG. 3 shows a detail of the cartridge system according to FIG. 1 in a perspective view.

The cartridge system shown in FIG. 1 through 3 essentially consists of a mixer 1 and a double cartridge that is formed by two containers 2*a*, 2*b*, which are integrally connected, In each of the two containers 2*a*, 2*b*, a delivery plunger 3*a* or 3*b* is respectively provided for delivering the components contained in the containers. The delivery plungers can be displaced by a device—not shown—within the containers. On the side opposite to plungers 3*a*, 3*b*, the containers respectively have an outlet connector 4*a*, 4*b*.

If the two containers 2*a*, 2*b* as shown in FIG. 1 are of different height (long in axial direction of the containers) the component contained in the higher container (2*a* in FIG. 1) can flow faster into mixer 1, because the corresponding channel 4*a* is shorter.

Outlet connectors 4*a*, 4*b* are surrounded by a ring 5 provided on the front closing wall of the double cartridge that has a thread 6 on its inner side. As can also be seen in FIG. 1, connectors 4*a*, 4*b* (in FIG. 1 upward) protrude over ring 5. Outlet connectors 4*a*, 4*b* are at a distance to each other so that a gap or free space remains between them that is identifiable in FIG. 1. On the side of the cartridge facing away from ring 5, a flange or the like can be provided in order to mount the cartridge in a suitable delivery device.

As can be seen in the enlarged illustration of FIG. 3, the upper facing wall in FIGS. 1 and 2 partially extends over the two cylindrical containers 2*a*, 2*b*, so that ring 5 is enclosed by a base that is penetrated by the two outlet connectors 4*a*, 4*b* and also has a positioning aperture 7, which is trapeze-shaped, in the embodiment shown in FIG. 3, for example. Alternatively, the cross section can also be rectangular or triangular.

Mixer 1 is a so-called static mixer, i.e. it does not have an actively driven mixer element. In the embodiments according to FIG. 4 through 6, mixer 1 is respectively formed by two components, namely a mixer housing 8 and an insert 9 that is retained in housing 8 in axial direction, but is rotatable. This can be accomplished, for example, by a surrounding groove in housing 8, which snaps together with a bead-like protrusion of insert 9, as shown in FIG. 5.

Housing 8 of mixer 1 consists of an elongated cylindrical tube that can be tapered at its outlet end 10. This elongated cylindrical section of housing 8 forms the actual mixing area in its interior. In contrast, the end opposite to outlet end 10 of housing 8 is flared with respect to this cylindrical area and designed as a coupling section for fastening mixer 1 to the cartridge (container 2*a*, 2*b*). For this, the coupling section has an outer thread 11, which is formed by several threaded sections according to the embodiment in FIG. 2 through 4, while an overlapping thread is provided in the embodiment according to FIGS. 5 and 6. Additionally, bordering on thread 11, a profiled section can be provided that facilitates the actuation of mixer 1, in particular, screwing mixer 1 into the ring of the cartridge.

Insert 9 has a plate 12 at which a mixer element 13 is formed, for example, a mixing helix, as well as inlet connectors 14*a*, 14*b*. The size of inlet connectors 14*a*, 14*b* is dimensioned in such a way that these can be inserted into outlet connectors 4*a* or 4*b* of the cartridge. For this purpose, inlet connectors 14*a*, 14*b* are located at a distance to each other, whereby additionally, a separating wall 15 is provided between the inlet connectors, which protrudes further from plate 12 than inlet connectors 14*a*, 14*b*. Separating wall 15 can thus engage with the gap or free space between outlet connectors 4*a*, 4*b* and thus prevent that, for example, components from outlet connector 4*a* end up at inlet connector 14*b* or the reverse.

In the illustrated embodiment, a positioning element 16 is formed at one end of separating wall 15 that is elongated with respect to it, which has an approximately triangular or trapeze-like cross section and can thus be inserted accurately fitting into positioning aperture 7 of the cartridge. Positioning element 16 thereby projects not only over separating wall 15 and inlet connectors 14*a*, 14*b*, but also protrudes over housing 8 of mixer 1 in the direction toward the cartridge. This has the effect that when mixer 1 is placed on the cartridge, first positioning element 16 enters into the space surrounded by ring 5 in the absence of the remaining components of mixer 1 coming in contact with the cartridge or its outlet connectors. Only when positioning element 16 is engaged with positioning aperture 7 of the cartridge can mixer 1 be placed onto the cartridge so that thread 11 of the mixer engages with thread 6 of the cartridge. By screwing housing 8 of mixer 1 into ring 5 of the cartridge, outlet connectors 4*a*, 4*b* and inlet connectors 14*a*, 14*b* then also become engaged. Positioning element 16 thereby penetrates through aperture 7 with its free end, so that the exact alignment of the mixer can be controlled even from the outside. To do so, the free end of positioning element 16 can be colored or marked in another way.

To facilitate the insertion of positioning element 16 into positioning aperture 7, positioning element 16 can, as shown, be slanted at its free end or tapered conically. Additionally, in the base of ring 6, ribs or similar elements can be provided that guide positioning element 16 in the direction toward positioning aperture 7. In the illustrated exemplary embodiments, positioning element 16 is formed at mixer 1 and the corresponding aperture 7 at the cartridge. The advantages according to the invention can also be realized, however, when the positioning element is formed at the cartridge and the aperture at the mixer.

On the side of plate 12 that is opposite to positioning element 16, an additional separating wall 17 can be provided that is aligned perpendicular to first separating wall 15 in the illustrated embodiment, so that separating wall 17 separates the components flowing in through inlet connectors 14*a*, 14*b* into two streams respectively. Thereby, mixer element 13, according to a preferred embodiment, is connected with separating wall 17 by a predetermined breaking point. This is especially important for previously used mixers in whose mixing area the two-component material has hardened and that remain, as is customary, as closure until the cartridge is used again. Because of the rigid one-part connection between mixer helix and inlet channels, it is advantageous to provide the predetermined breaking point on the mixer helix in the proximity of the inlet channels to ensure that it is easy to screw off the mixer, and to avoid having to screw the helix against the polymerized material.

As can be seen, in particular, in the illustration in FIG. 5, starting at inlet connector 14*a* for the component that is smaller by volume, from container 2*a*, a cylindrical channel 18 extends in the direction toward the mixing area. Separating wall 17 can thereby partially extend into channel 18 and/or channel section 19*a*.

In contrast, subsequent to inlet connector 14*b* for the larger component by volume coming out of container 2*b*, the volume widens downstream of plate 12, toward the reservoir chamber that has a larger cross section surface than the corresponding inlet connector 14*b*. Thereby, inlet connector 14*b* forms a first channel section 19*a* and reservoir chamber 19*b*, an enlarged channel section.

Downstream of reservoir chamber 19*b*, an aperture 19*c* or an additional channel section can be provided that ends, for example in the mixing area.

The size of reservoir chamber 19*b* can thereby be variably changed by the position of a wall 20 that extends perpendicular to separating wall 17 in the illustrated embodiment. To the extent the component entering through inlet connector 14*b* tends to run forward, the amount of this component that runs forward can first be captured in reservoir chamber 19*b* before the subsequent component stream reaches into the mixing area together with the other component. As can be seen in FIG. 5, the component entering through inlet connector 14*b* can arrive in the mixing chamber coming from the reservoir chamber 19*b* without any further redirection. This minimizes the flow resistance.

Figure 4:
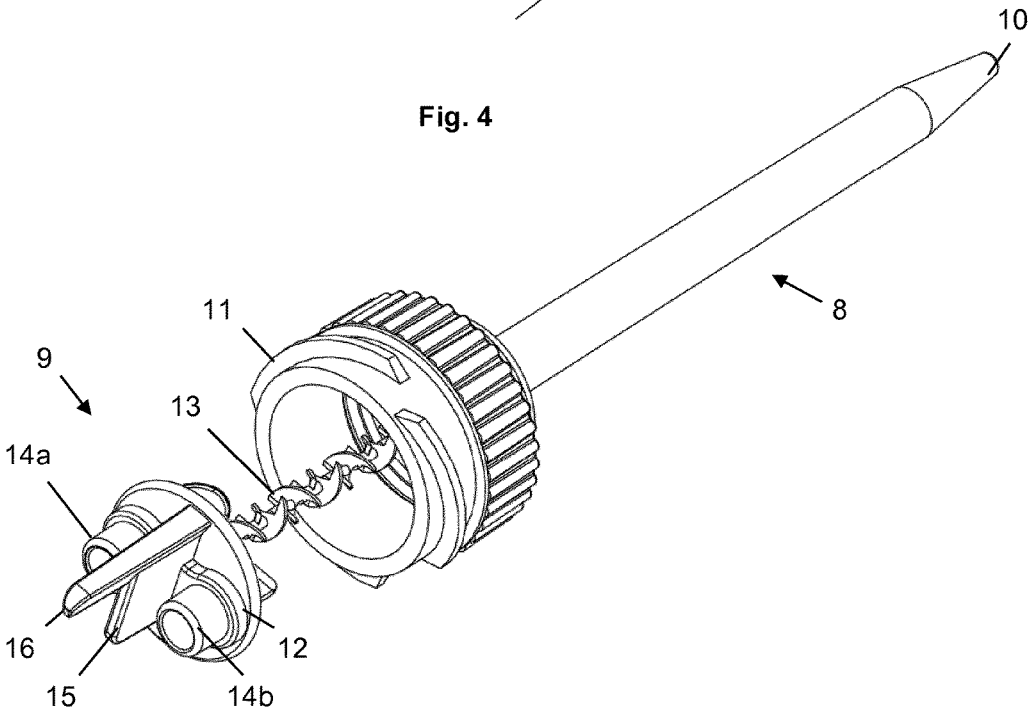
FIG. 4 shows the components of a mixer according to the invention for the cartridge system according to FIG. 1 in a perspective view.
Figure 5:
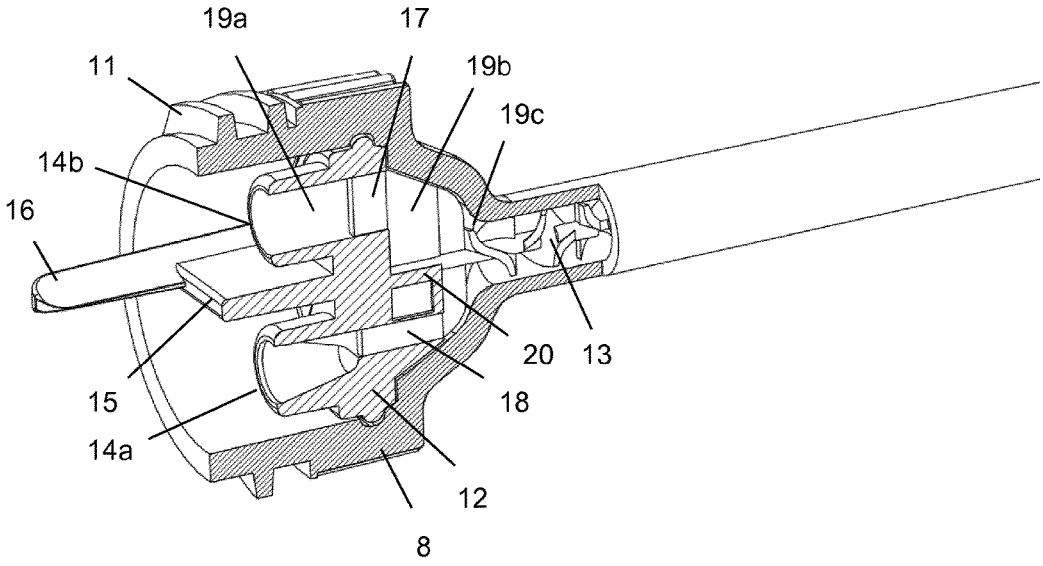
FIG. 5 shows a mixer according to the invention for the cartridge system according to FIG. 1 according to a second embodiment.
Figure 6:
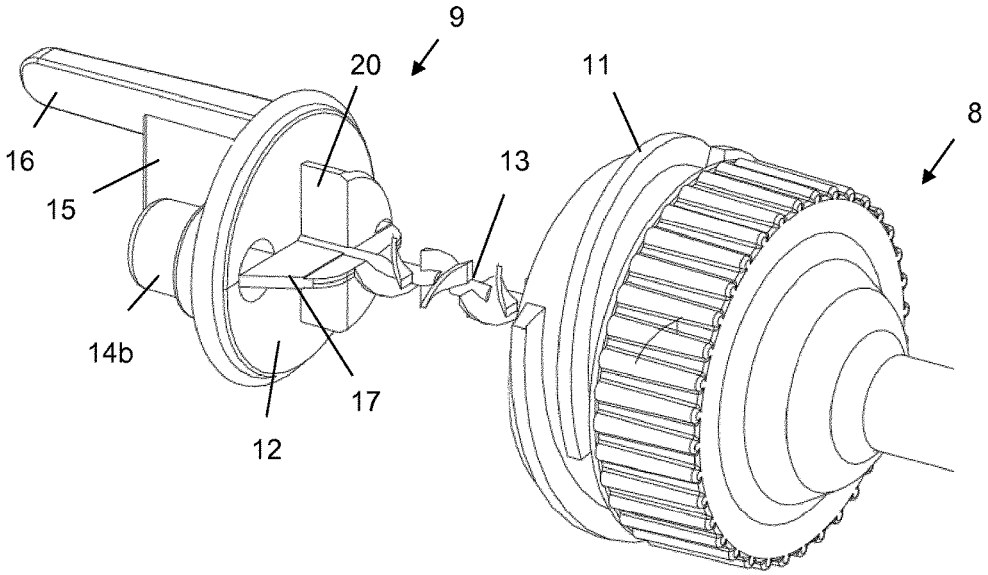
FIG. 6 shows the components of the mixer according to FIG. 5 in a perspective view.

Static mixer 1 that is shown in FIG. 4 through 6 has several advantages with respect to known static mixers. First, a secure and firm interlock with the cartridge is possible as a result of threaded connection 6, 11. Additionally, the mixer is enabled to be released and lifted off the cartridge by being screwed off. The two-part construction of mixer 1 also has cost advantages. The free rotatability of insert 9 in mixer housing 8 thereby makes a simple and cost effective assembly in which—different than in known mixers—no attention needs to be paid to the alignment of the components. Separating wall 15 and outlet connectors 4*a*, 4*b* that protrude opposite to ring 5 additionally largely prevent contaminations or cross contaminations.

As the result of a different size or geometry of positioning element 16, and corresponding aperture 7 in the base of threaded collar 5, a clear association between certain cartridges and the pertaining mixers can be defined. This is especially advantageous for distinguishing between different mixing ratios of the components. Thus, for example, a mixer for a mixing ratio of 1:1 of the components cannot be placed onto a cartridge designated for a mixing ratio of, for example, 1:10 and the reverse.

Figure 8:
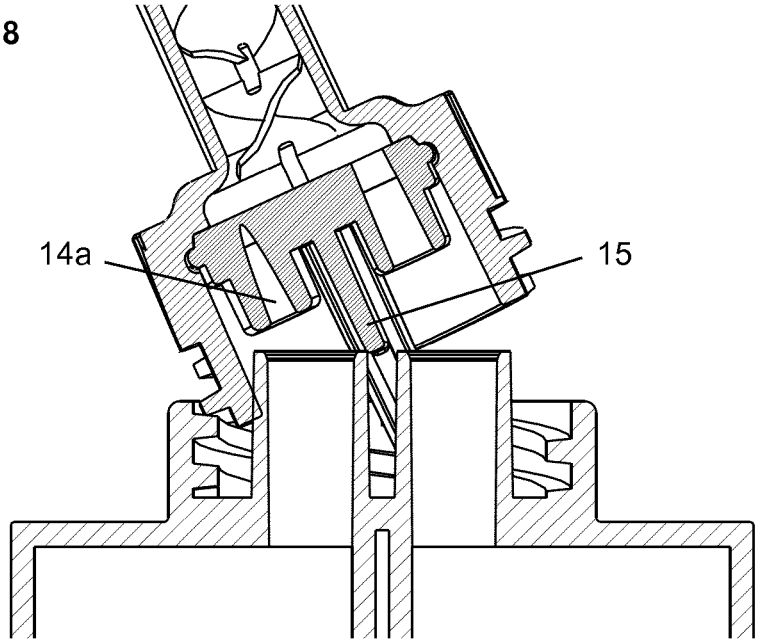
FIG. 8 shows a cross section of the cartridge system.

Further, in FIGS. 5 and 8, a cross section tapering is formed in inlet connector 14*a* that takes the mixing ratios of the components other than 1:1 into consideration at the same outer diameter of the two inlet connectors.

Figure 7:
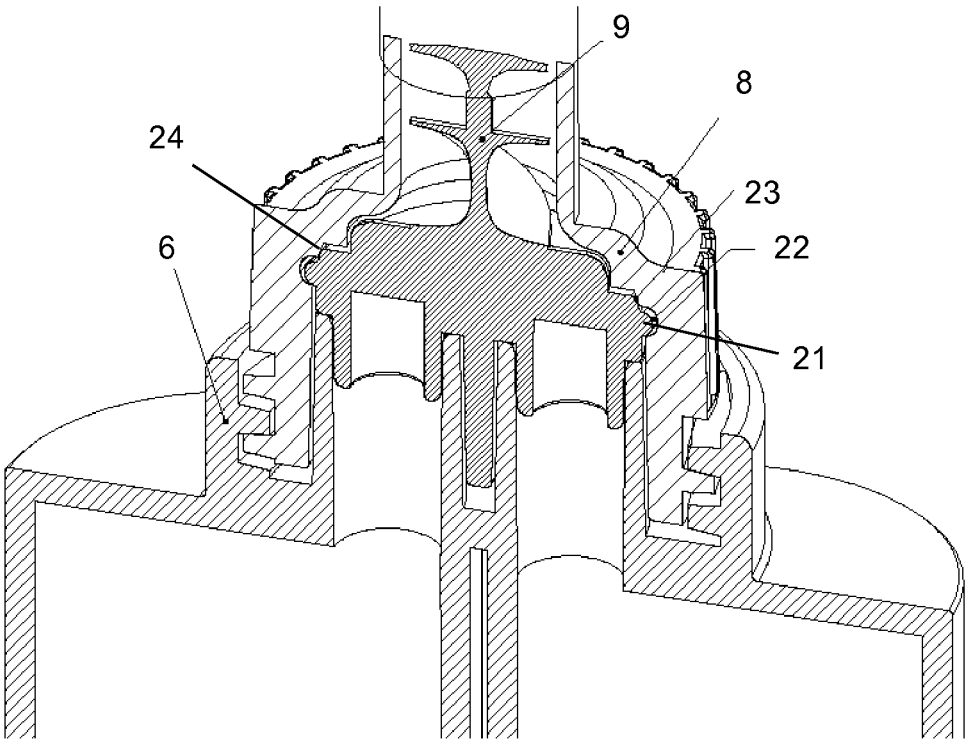
FIG. 7 shows a detail of the cartridge system in longitudinal cross section.

In FIG. 7, a gasket seal is shown in detail between the two components of the mixer. Hereby, a cone seal is provided in the mixer between the inner side of housing 8 and the outer side of insert 9. In order to connect these two components with each other in a freely rotatable manner, a catch connection with a surrounding groove 21 is provided in the housing and a surrounding bar 22 in the insert. The gasket seal has corresponding conical sealing surfaces 23, 24 that are formed above the groove or bar on the inner side of housing 8 and the outer side of insert 9 in FIG. 7. When the mixer is screwed in—for reasons of the required free rotatability—the at first open surrounding cone seal is positively closed and friction-locked in the end position.

FIG. 8 shows a further cross section view of the cartridge system, whereby the case is shown when a user attempts to place the mixer onto the cartridge incorrectly (tilted). An important feature of the cartridge system according to the invention is the avoidance of an undesired carryover of catalytic components and base components that could lead to respectively contaminate the other paste component. This could occur as the result of an accidental, unintended insertion of the positioning latch first into one and then into the other channel, or by touching the inlet and outlet channels of cartridge and mixer during an unfavorably tilted placement in the wrong position, or analogously, in the case of a tilted reinsertion of a locking stopper These unfavorable constellations are avoided by the interaction and the geometric design and configuration of the positioning latch, thread and separating wall, as shown in FIG. 8. Hereby, according to the invention, the positioning latch is designed at the mixer (or at a locking stopper) in such a way that it cannot be inserted into the outlet channels. Further, the separating wall is dimensioned in such a way that it only allows small tilting angles between the outlet channel of the cartridge. At the outlet channels of the cartridge, contours can be added that further limit the play for the separating wall used with respect to unfavorable tilting angles. A locking stopper can have an additional sleeve-like collar (at the position, where the thread is located on the mixer) and thus also avoid unfavorable tilting angles.

Figure 9:
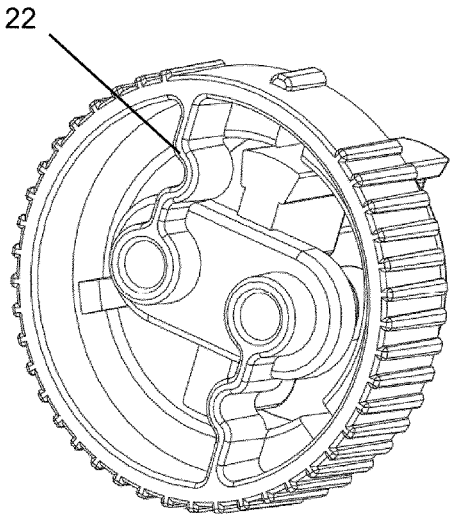
FIG. 9 shows a one piece locking element in a perspective view.
Figure 10:
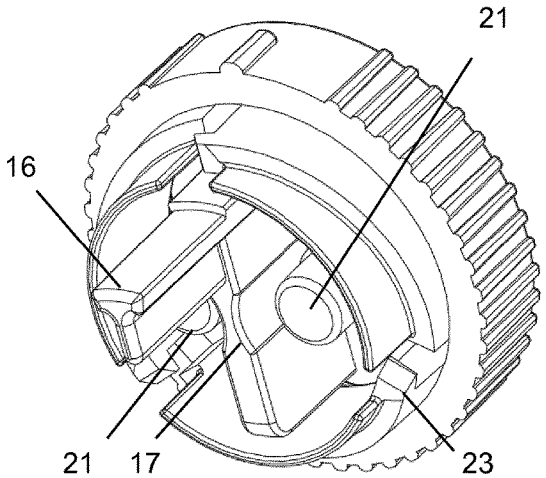
FIG. 10 shows the locking element according to FIG. 9 in a perspective view.

Independent of the previously described features of the mixer and/or the cartridge, the invention also relates to a one-piece locking element shown in FIGS. 9 and 10, which can be placed on the containers 2*a*, 2*b* that form a double cartridge, instead of mixer 1. Two stoppers 21 are provided for closing the double cartridge, which can be inserted into outlet connectors 4*a* or 4*b* and seal them. The stoppers are respectively connected with a sleeve via a bar 22 that acts as torsion spring, which can be inserted into the collar of the outlet end of the double cartridge. A flared edge of the sleeve that has a knurling rests on the front of the collar, when the locking element has been placed in the double cartridge to seal it.

The locking element can be secured in the collar (ring 5) by means of engagement hooks 23 that engage with the threaded segments of inner thread 6 and thereby interlock the locking element on the double cartridge. To release the locking element, the sleeve with the knurling can be slightly rotated, whereby bar 22 deflects, as stoppers 21 first continue to be stuck in outlet connectors 4*a* or 4*b*. This twisting of bar 22 that acts as torsion element makes it possible that the engagement hooks are disengaged from the threaded segments of inner thread 6, so that the locking element can be removed from the double cartridge.

Similar to the mixer, the locking stopper has a positioning latch 16 that can be designed in such a way that after it penetrates outward through a corresponding aperture in the cartridge, it becomes visible to the user. This has the advantage of a visual control as to whether the locking stopper and/or the positioning latch have been inserted properly. The torsion element of the locking stopper can, as shown in FIG. 9, have a radial S shape in order to also secure a corresponding rotation path even when the locking stoppers having small diameters.

The locking stopper shown in FIG. 10 is also equipped with a separating wall 17 that—similar to the mixer—lies between stoppers 21. In the illustrated embodiment, separation wall 17 is provided with constrictions in the proximity of stoppers 21, which makes it easier to place the lock on it without any tilting.

Figure 11:
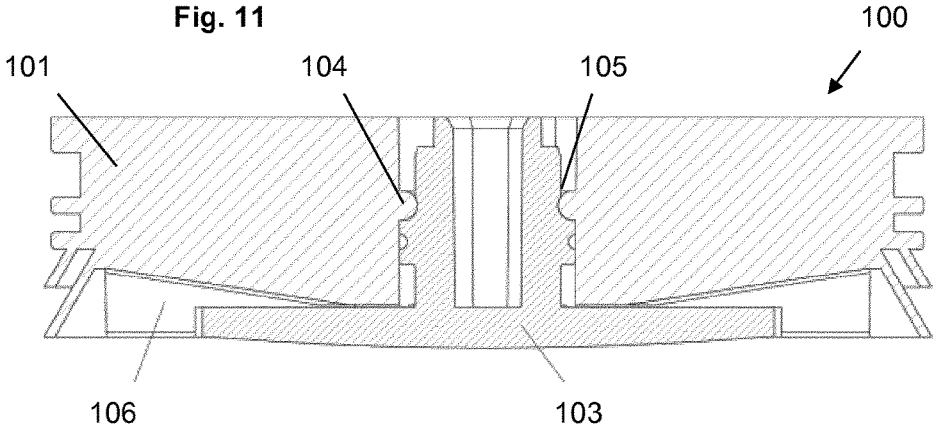
FIG. 11 shows a delivery plunger with screw cap in cross section.
Figure 12:
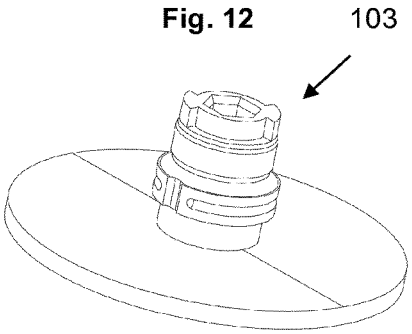
FIG. 12 shows a screw cap according to FIG. 11 in a perspective view.
Figure 13:
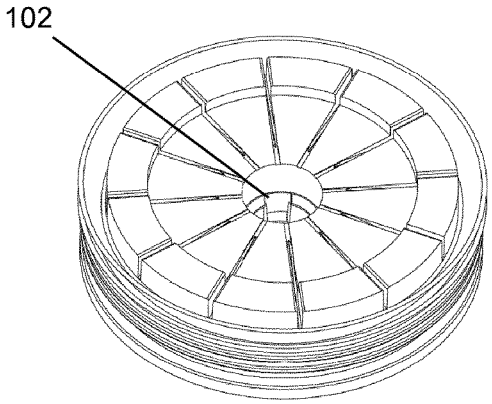
FIG. 13 shows the delivery plunger according to FIG. 11 in a perspective view.

In FIGS. 11 through 13, a delivery plunger with screw cap is shown which can be used in the cartridge system according to the invention for delivering the components out of the containers. Hereby, the plunger is provided with a vent that makes it possible to let air escape from the respective container when it is filled with the component and the delivery plunger is used. As several substances have the tendency to react with the residual air remaining in the cartridge after the cartridge has been filled and the plunger is being used in the cartridge, the goal is to let as much of the residual air as possible escape from the container. Possibly remaining residual air in the container between the plunger and the substance in the cartridge is further considered to be disadvantageous, because the residual air forms a compressible pillow that makes the precision of dosing the substance during an application out of the cartridge more difficult.

Plunger 100 shown in FIGS. 11 through 13 has a base body 101 that has a lateral wall provided with sealing means and a front wall that has a vent 102. This vent 102 extends through the entire base body, so that an air exchange between the side of the front wall (in feed direction) and the rear side of plunger 100 is possible. Thereby, in vent 102, a locking element 103 is mounted rotatable, whereby a vent can be opened or closed by a relative rotation of locking element 103. In other words, it is possible to establish or block the flow connection between the side of plunger 100 that lies in the feed direction and the rear side of the plunger 100 by a rotation of locking element 103.

For this, on the inner surface of vent 102, a surrounding protrusion 104 is formed that engages with a corresponding groove 105 in locking element 103 in order to interlock with it. Protrusion 104, as well as groove 105 are respectively provided with through holes that can be brought into alignment in order to release a ventilation channel, or into non-alignment in order to close the ventilation channel. Thereby, the bore hole extends through groove 105 that is perpendicular to it, which can be formed slightly deeper than the bore so that protrusion 104 can securely close the bore holes.

To optimize the imperviousness of the plungers with screw cap (discharge of impression material out of the closed ventilation channel under delivery conditions) star-shaped ventilation slots 106 are designed conically tapered, so that the total cross section surface is reduced to a fraction, for example, to 1/100 of the original cross section surface. In this way, trapped air can continue to escape unimpeded when the cartridge is being closed, however, there is a strong impediment against impression material passing toward the ventilation valve.

Figure 14:
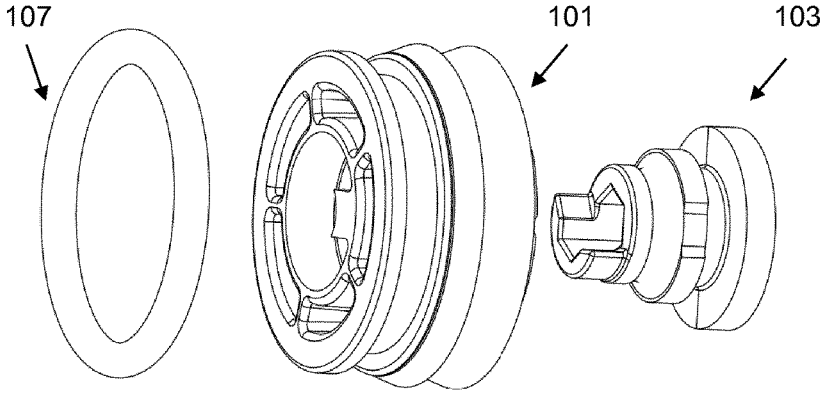
FIG. 14 shows the components of a further delivery plunger with screw cap in a perspective view.
Figure 15:
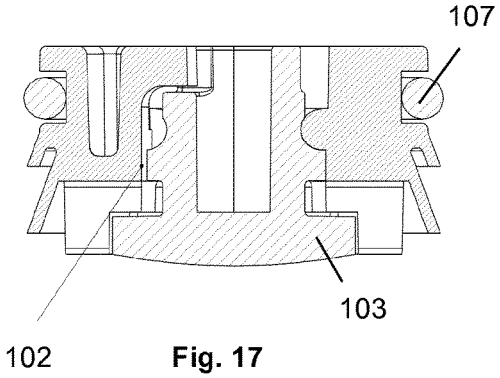
FIG. 15 shows a cross section view of the open delivery plunger according to FIG. 14.
Figure 16:
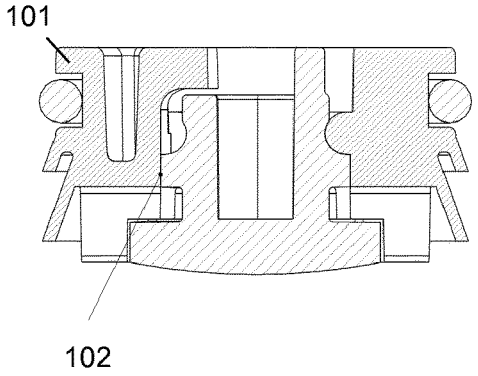
FIG. 16 shows a cross section view of the closed delivery plunger according to FIG. 14.

An alternative embodiment of a delivery plunger with screw cap is shown in FIGS. 14 through 16, in turn consisting of a base body 101 and a locking element 103. Additionally, a gasket ring 107 is provided. In the embodiment in FIGS. 14 through 16, only a single vent 102 is provided between base body 101 and locking element 103, so that this variant can also be used in close quarters. A comparison of FIGS. 15 and 16 shows how vent 102 opens (FIG. 15) or closes (FIG. 16) depending on the rotational position of locking element 103 in base body 101.

Figure 17:
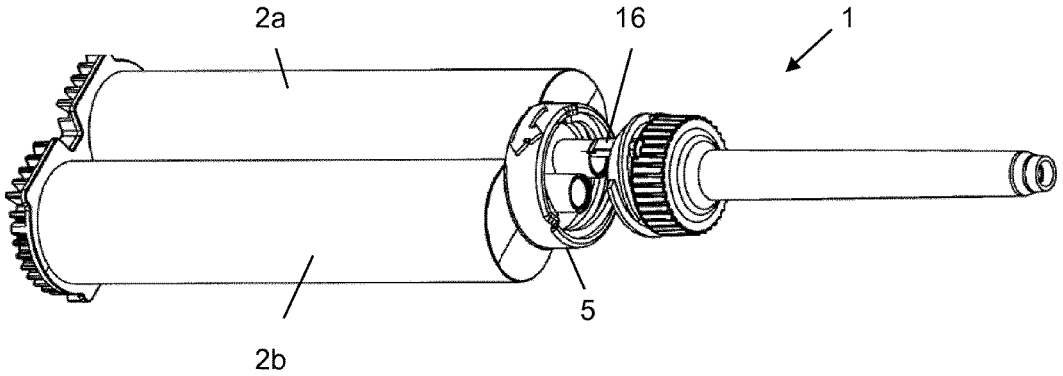
FIG. 17 shows a cartridge system for a mixing ratio of the components of 1:1 in a perspective view.

A cartridge for a mixing ratio of the components of 1:1 is shown in FIG. 17. The two containers 2*a*, 2*b* hereby have the same dimensions.

REFERENCE NUMBERS

1 Mixer
2*a*, 2*b* Container

3*a*, 3*b* Delivery plunger
4*a*, 4*b* Outlet connector
5 Ring
6 Thread
7 Positioning aperture
8 Housing
9 Insert
10 Outlet aperture
11 Thread
12 Plate
13 Mixing element
14*a*, 14*b* Inlet connector
15 Separating wall
16 Positioning element
17 Separating wall
18 Channel
19*a* First channel section
19*b* Reservoir chamber
19*c* Aperture
20 Wall
21 Stopper
22 Bar (torsion element)
23 Engagement hook
100 Plunger
101 Base body
102 Vent
103 Locking element
104 Protrusion
105 Groove
106 Ventilation slot
107 Gasket ring

What is claimed is:

1. A cartridge system with two containers wherein each container comprises a single outlet connector and a common connection section having a positioning aperture for a mixer, comprising:

a static mixer comprising a first inlet connector, a second inlet connector, and a positioning element, wherein the common connection section comprises a ring, the ring comprising an inner thread that surrounds the single outlet connectors of the two containers, the mixer further comprising a housing comprising an outer thread and an insert wherein the positioning element projects beyond both the first inlet connector and the second inlet connector in a direction toward the two containers, the insert is axially secured in the mixer housing and rotatable relative to the mixer housing, whereby a length of the first inlet connector, a length of the second inlet connector and a length of the positioning element, and a position of the positioning aperture are coordinated with each other in such a way, that when the mixer is placed on the two containers, the positioning element engages with the positioning aperture.

2. The cartridge system of claim 1, wherein the positioning element engages with the positioning aperture before the inner thread of the ring and the outer thread of the mixer engage.

3. The cartridge system of claim 1, wherein the positioning element engages with the positioning aperture before the first and second inlet connectors come into contact with the single outlet connectors of the two containers.

4. The cartridge system of claim 1, wherein the inner thread of the ring and the outer thread of the mixer engage before the first and second inlet connectors come into contact with the single outlet connectors of the two containers.

* * * * *